US005805175A

United States Patent [19]

Priem

[11] Patent Number: 5,805,175

[45] Date of Patent: Sep. 8, 1998

[54] METHOD AND APPARATUS FOR PROVIDING A PLURALITY OF COLOR FORMATS FROM A SINGLE FRAME BUFFER

[75] Inventor: Curtis Priem, Fremont, Calif.

[73] Assignee: Nvidia Corporation, Sunnyvale, Calif.

[21] Appl. No.: 423,001

[22] Filed: Apr. 14, 1995

[51] Int. Cl.[6] ..... G09G 5/06

[52] U.S. Cl. ..... 345/509; 345/199; 345/507

[58] Field of Search ..... 395/164, 501, 395/508, 509, 131, 187, 507; 345/153, 154, 155, 185, 186, 189, 199; 364/707

[56] References Cited

U.S. PATENT DOCUMENTS

| | | | |
|---|---|---|---|
| 4,712,099 | 12/1987 | Maeda | 345/199 |
| 4,982,378 | 1/1991 | Matsushita | 365/201 |
| 5,228,120 | 7/1993 | Farr et al. | 345/155 |
| 5,274,753 | 12/1993 | Roskowski et al. | 395/135 |
| 5,339,445 | 8/1994 | Gasztonyi | 364/707 |
| 5,426,731 | 6/1995 | Masukane et al. | 395/501 |
| 5,504,855 | 4/1996 | Priem et al. | 395/164 |
| 5,581,280 | 12/1996 | Reinert et al. | 345/200 |

*Primary Examiner*—Richard Hjerpe
*Assistant Examiner*—Lun-Yi Lao
*Attorney, Agent, or Firm*—Stephen L. King

[57] ABSTRACT

An arrangement which provides for storing a single lookup/bypass bit with each pixel stored in a frame buffer to indicate whether the color format used to display that pixel on the output display is to use the lookup tables, and for storing an indication apart from the frame buffer which to indicate the decode format for the pixels stored in the frame buffer and retrieved for display by programs providing graphics output in different color formats. The arrangement allows fifteen bit color formats to be stored in standard sized frame buffers without the addition of memory devices.

21 Claims, 4 Drawing Sheets

| | Single decode | Triple decode |
|---|---|---|
| Bypass | Gray scale | True color |
| Color lookup | Indexed | Direct color |

Fig. 1

Lu/bypass bit

| Decode Mode | 15 | 14 | 13 | 12 | 11 | 10 | 9 | 8 | 7 | 6 | 5 | 4 | 3 | 2 | 1 | 0 | |
|---|---|---|---|---|---|---|---|---|---|---|---|---|---|---|---|---|---|
| X | 1 | Red bypass | | | | | Green bypass | | | | | Blue bypass | | | | | True color |
| 0 | 0 | Red lookup | | | | | Green lookup | | | | | Blue lookup | | | | | Direct color |
| 1 | 0 | X | X | X | X | X | X | X | Single lookup | | | | | | | | Indexed |

Lu/bypass bit

| Decode Mode | 31 | 30 | 29 | 28 | 27 | 26 | 25 | 24 | 23 | 22 | 21 | 20 | 19 | 18 | 17 | 16 | 15 | 14 | 13 | 12 | 11 | 10 | 9 | 8 | 7 | 6 | 5 | 4 | 3 | 2 | 1 | 0 | |
|---|---|---|---|---|---|---|---|---|---|---|---|---|---|---|---|---|---|---|---|---|---|---|---|---|---|---|---|---|---|---|---|---|---|
| X | 1 | X | X | X | X | X | X | X | Red bypass | | | | | | | | Green bypass | | | | | | | | Blue bypass | | | | | | | | True color |
| 0 | 0 | X | X | X | X | X | X | X | Red lookup | | | | | | | | Green lookup | | | | | | | | Blue lookup | | | | | | | | Direct color |
| 1 | 0 | X | X | X | X | X | X | X | X | X | X | X | X | X | X | X | X | X | X | X | X | X | X | X | Single lookup | | | | | | | | Indexed |

Fig. 4

METHOD AND APPARATUS FOR PROVIDING A PLURALITY OF COLOR FORMATS FROM A SINGLE FRAME BUFFER

BACKGROUND OF THE INVENTION

1. Field Of The Invention

This invention relates to computer systems, and more particularly, to methods and apparatus for providing a plurality of color formats from the output of a frame buffer in a multitasking operating system.

2. History Of The Prior Art

Early computers were able to present color only in black and white or other so called monochrome (two color) modes. As computers became more proficient and the prices of the various components dropped, various modes of color display were adopted. Initially, a number of different color display modes were tried, but eight bit indexed color modes finally provided acceptable color displays. More recently, the availability of large amounts of memory at reasonable prices has made colors display modes using more bits economically feasible. However, it is very difficult to display the outputs of application programs using different color modes simultaneously.

Personal computer systems presently available utilize a frame buffer joined to a system bus to provide output to a display monitor. In personal computers based on the design of the original IBM personal computers utilizing Intel X86 or similar processors, the frame buffer is set by commands provided by a setup program to display colors in only one of a number of selectable modes or formats. Theoretically, these modes may include any number of bits. As a practical matter, those modes which utilize one, two, or four bytes of data space in the frame buffer to store the data describing a pixel make best use of space and, therefore, have become prevalent.

The color on an output display is typically generated by one of two methods. The data in one method are digital color values which are sent from the frame buffer as pixel values straight to digital-to-analog (DAC) converter circuitry that provides the red, green, and blue signals for operating an analog color monitor. The data in the second method are not digital color values but merely numbers which must be converted to digital color values through the use of lookup tables before being sent to the DAC circuitry. This second method is variously referred to as "indexed," "direct," or "lookup." Because they do not use lookup tables, modes using the first method are often referred to as "non-indexed," "bypass," or by a mode name which does not refer to lookup tables or their lack.

As may be seen, if eight bit data values are stored in the frame buffer to represent a pixel on the display, 256 different possible values may be stored. If these eight bits are divided into two bit increments and each two bit increment is sent straight to the DAC as a digital color value of red, green, or blue, only four shades of each color are available; and an uninteresting array of colors is provided. Generally, therefore, eight bits are not used in this manner. However, any eight bit mode represents 256 possible values. If these bits are sent as a single value to the DAC bypassing the lookup tables, they may be furnished to each of the red, green and blue inputs of a color monitor and used to represent gray scale values for which 256 shades are sufficient. On the other hand, the eight bit mode which uses the lookup tables is more interesting because each of the 256 numbers available may be used to select one of 256 shades of red from a red lookup table, one of 256 shades of green from a green lookup table, and one of 256 shades of blue from a blue lookup table. This mode which indexes the single eight bit value to each of three different lookup tables is referred to as "eight bit indexed" color mode and is the most prevalent mode of color display at present.

There are two other color modes which are important in IBM personal computers for reasons which will become apparent. One of these modes uses fifteen bits to store five bits each of red, green, and blue pixel values in the frame buffer and sends these five bit groups straight to the DAC bypassing the lookup tables. This mode is referred to as "true color" mode. This mode was designed to make best use of the data space afforded by two bytes of data space in the frame buffer. The last prevalent mode uses twenty-four data bits available in a thirty-two bit data space to provide eight bits which represent red, eight bits which represent green, and eight bits which represent blue. The eight bit red value is sent to a red lookup table, the eight bit green value is sent to a green lookup table, and the eight bit blue value is sent to a blue lookup table. These values are modified by the color tables to provide more accurate colors for particular purposes such as gamma correction or color calibration. This mode is referred to as "direct color." The mode names used here are those used in the X Windows windowing system devised at Massachusetts Institute of Technology. Since this system utilizes the largest number of modes and names these modes relatively consistently, that convention is used here. In this context, so long as a single group of bits is sent to all of the lookup tables, no matter what the number of bits, the mode will be referred to in this specification as "indexed." When three groups of bits are sent to individual ones of the lookup tables, no matter what the number of bits, the mode will be referred to in this specification as "direct." When three groups of bits are sent to straight to the DAC bypassing the lookup tables, no matter what the number of bits, the mode will be referred to in this specification as "true color."

So long as a computer is presenting only a single application program on its output display, the selection of color modes by a setup program works well. If a computer is presenting an older program which presents color in eight bit indexed mode, then graphics output display circuitry may be initialized by setup commands to load the lookup tables correctly, to store pixel data in a frame buffer in the correct format, and to retrieve that data in the appropriate eight bit indexed format to correctly present the data on the output display monitor. Similarly, if a computer is presenting a newer program which presents color in a twenty-four bit direct color mode, then the graphics output display circuitry may be initialized by setup commands to load the lookup tables correctly, to store pixel data in a frame buffer in the correct format, and to present the pixel data in the appropriate twenty-four bit direct format on the output display.

When such an IBM personal computer is functioning with a multiprocessing operating system such as Microsoft Windows, however, a number of problems arise. If a plurality of programs are being run simultaneously and all of these programs use either the same true color format or gray scale format which does not use lookup tables, then the frame buffer may be appropriately initialized so that the output of all of the programs will be presented in the correct color modes. However, if a number of programs are being run simultaneously and some of these programs use different color modes (or use different lookup values if lookup tables are used), then the color displayed by at least one of the programs must be incorrect since the frame buffer can only be preset to a single color format.

Since it is desirable to be able to display correct color renditions of all of the different application programs which may be running simultaneously in different windows on the output display of a personal computer, the prior art has provided two bits which are stored with each pixel value in a frame buffer to describe the color mode by which the pixels are to be is stored in the frame buffer and read to the display. By providing these two color mode control bits, it has been possible to control both (1) whether lookup tables are used and (2) whether a single group of bits is decoded once for all of the color shades or three groups of bits are decoded individually for each of the three color shades. When using the lookup tables, if a single group of bits is decoded once for all color shades, the same value is sent to each of the three color lookup tables; while when three groups of bits are decoded individually for each of the three color shades, three different values are typically sent to each of three color lookup tables. This applies no matter how many bits are stored to represent each shade. When these two color mode control bits are included with the pixel data in the frame buffer, four color mode options are available to the circuitry which reads the frame buffer and interprets the pixel data to be displayed. The availability of these four options allows the presentation of the four color modes described above, i.e., gray scale, indexed color, true color, and direct color. It will be noticed that of these modes, two use the lookup tables, while two bypass the lookup tables; and two modes transfer a single group of bits (e.g., eight bits) either straight to the DAC or to all three lookup tables, while two modes transfer three groups of bits either straight to the DAC or one group to each of the three lookup tables. The use of two bits to control a number of different modes however many bits those modes include is illustrated in the truth table of FIG. 1 which uses the naming conventions described above and which should be referred to hereinafter for understanding the names used for particular modes. The availability of these color mode control bits allows older application programs to be presented in eight bit indexed color mode at the same time that newer application programs are being presented in fifteen bit true color mode or a twenty-four bit true color format (which is not yet widely utilized). So long as a single color format which uses the lookup tables is utilized with a plurality of color formats which do not utilize the lookup tables, the colors for each will be correct.

However, a major problem with this type of format declaration is that it requires two bits of color mode control data be stored in the frame buffer with each of the pixel values. If eight bits of pixel data are stored with two bits of color mode control data in a sixteen or thirty-two bit deep frame buffer, no problem arises. Similarly, if twenty-four bits of pixel data are stored with two bits of color mode control data in a thirty-two bit deep frame buffer, no problem arises. When, however, fifteen bit color modes are used with other formats, the problem arises. Since fifteen bit color modes represent each shade by five bits, adding two additional bits of color mode control data requires seventeen bits of pixel space in the frame buffer. This means that fifteen bit true color formats cannot be stored in a simple sixteen bit deep frame buffer but require at least one additional bit for each pixel stored. Similarly, fifteen bit formats cannot be stored in adjacent positions in a thirty-two bit deep frame buffer since the two pixels each require at least one additional bit for each pixel stored and a total of thirty-four bits.

This may appear on the surface to be a small problem. However, a very substantial number of application programs utilize fifteen bit formats and more are being written every day because fifteen bit color formats, whether true color or direct, provide the most cost effective way to represent a very wide range of colors on the display. However, with output displays presently available averaging approximately 1000×1000 pixels, this mode of storage requires at least one million additional memory devices to implement. This is not a small cost. In order to eliminate this cost, some well known graphics output circuitry utilizes only four bits to represent each of its shades of red, green, and blue (a total of 4,096 colors) in the frame buffer instead of what normally would be a fifteen bit format. It will be recognized that this severely limits the number of colors from which a selection may be made in a direct color mode and reduces the number of individual shades of red, green, and blue to only sixteen each in a bypass color mode.

It is desirable to eliminate this requirement for substantial additional memory to present sixteen bit formats while still allowing a plurality of different color formats to be correctly presented simultaneously on the output display.

SUMMARY OF THE INVENTION

It is, therefore, an object of the present invention to provide improved apparatus and a method for presenting color of different modes simultaneously in different windows of the same computer output display.

It is another object of the present invention to provide a new architecture capable of handling simultaneously color displays for different application programs having different color formats.

It is an additional object of the present invention to reduce the power usage in a computer graphics controller.

These and other objects of the present invention are realized in an arrangement which provides means for storing a single lookup/bypass bit with each pixel stored in a frame buffer to indicate whether the color format used to display that pixel on the output display uses or bypasses the color lookup tables, and means for storing an indication apart from the frame buffer which indicates whether the pixel data stored in the frame buffer is to be stored and retrieved for display in a single group or three groups.

These and other objects and features of the invention will be better understood by reference to the detailed description which follows taken together with the drawings in which like elements are referred to by like designations throughout the several views.

BRIEF DESCRIPTION OF THE DRAWINGS

FIG. 1 is a truth table illustrating different color modes of operation used in personal computers.

FIG. 4 is a diagram illustrating exemplary arrangements for storing pixels in a frame buffer in accordance with the present invention.

NOTATION AND NOMENCLATURE

Some portions of the detailed descriptions which follow are presented in terms of symbolic representations of operations on data bits within a computer memory. These descriptions and representations are the means used by those skilled in the data processing arts to most effectively convey the substance of their work to others skilled in the art. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention; the operations are machine operations. Useful machines for performing the operations of the present invention include general purpose digital computers or other similar devices. In all cases the distinction between the method operations in operating a computer and the method of computation itself should be borne in mind. The present invention relates to a method and apparatus for operating a computer in processing electrical or other (e.g. mechanical, chemical) physical signals to generate other desired physical signals.

DETAILED DESCRIPTION

Figure 2:
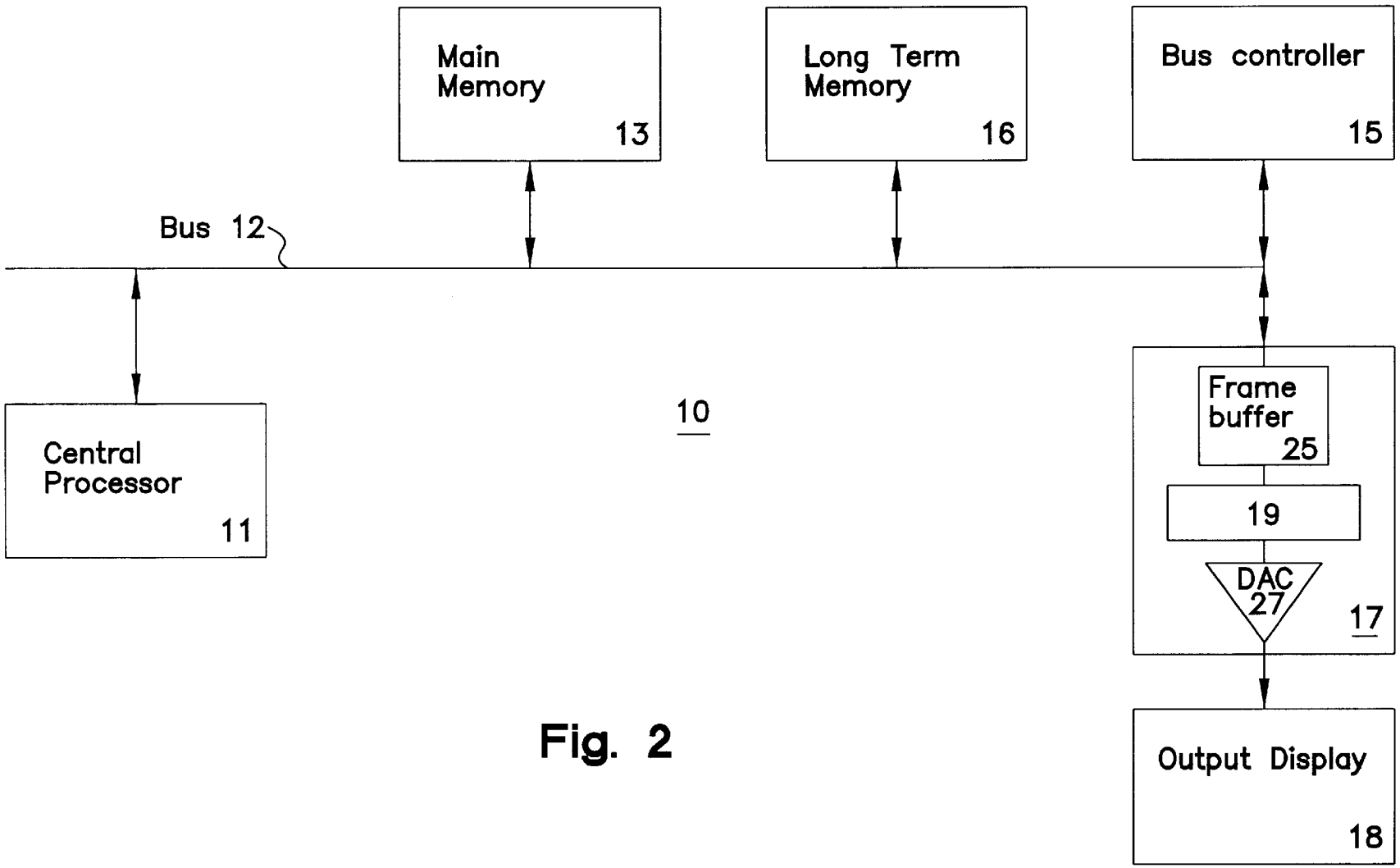
FIG. 2 is a block diagram of a computer system which may utilize the present invention.

The present invention has application in any system utilizing a high quality color output display, such as a computer system. Referring now to FIG. 2, there is illustrated a block diagram of a system 10 configured in accordance with the teaching of the prior art. A portion of such a system 10 includes a central processing unit 11 which executes the various instructions provided to control the operations of the system 10. The central processing unit 11 is joined to a bus 12 adapted to carry information between the various components of the system 10. Typically the bus 12 used in a personal computer is an Industry Standard Association (ISA) bus having the limiting characteristics of that bus although other buses such as a Peripheral Component Interconnect (PCI) or VESA Local (VL) bus may be used. Joined to the bus 12 is main memory 13 which is typically constructed of dynamic random access memory arranged in a manner well known to those skilled in the prior art to store information during a period in which power is provided to the system 10.

Also connected to the bus 12 are various peripheral components such as long term memory 16 and circuitry such as graphics output display circuitry 17 which may include a frame buffer to which data may be written which is to be transferred to an output device such as an output display monitor 18. A graphics output display circuit 17 typically provides the means to control the mode of color output which is presented on the output display by controls which are set when the initial conditions of the computer system are established. A bus controller 15 controls access to the bus 12 by the various components joined thereto.

As may be seen, graphics output display circuitry 17 includes a frame buffer 25 which may be used to stored the pixel data to be presented on the output display device 18. In a computer system running an operating system such as MS DOS where only a single application program is operating at any time, the application program typically uses the central processing unit to write pixel data directly to the frame buffer. On the other hand, in multi-processing operating systems, the central processing system typically runs a graphics driver process which writes the pixel data to the frame buffer in appropriate bit positions to function in the color mode which has been preset by the setup program. This allows pixel data in eight bit indexed mode, for example, to be written to the frame buffer so that it is positioned in the first eight bits of a sixteen bit pixel space or in the first eight bits of a thirty-two bit pixel space.

The pixel data stored in the frame buffer is transferred to the output display device 18 using the facilities of translation circuitry 19 and a digital-to-analog converter (DAC) circuit 27. The translation circuitry 19 may translate (if necessary) the raw pixel data stored in the frame buffer 17 into the proper color values so that correct colors and sizes may be displayed on the display device 18. Alternatively, the translation circuitry 19 may send color values from the frame buffer straight to the DAC 27 without translation. The DAC 27 then converts the digital color pixel data which is presented in the correct color format into analog data to which the display device 18 may respond.

As was pointed out above, when pixel data is stored in a frame buffer in the typical multiprocessing system by a driver process, it may be stored in any of a number of different pixel positions representing different color modes which are later translated by the circuitry of the DAC to provide a correct representation on the output display. In early arrangements, a single bit of data was used to represent a pixel. If that bit were a one, the bit might represent a first color; while if that bit were a zero, it would represent another color. Typically, these colors were black and white, black and green, or black and yellow. Such formats have usually been referred to as monochrome formats because only a single color is used in addition to the background color.

As random access memory devices became less expensive and computer equipment became more sophisticated, formats were devised by which a number of colors could be provided together on the output display. Typically, this involves providing a number of bits in each pixel value to represent each of three different basic colors, i.e., red, green, and blue. Some of these formats and the method of their translation may be understood by referring to FIG. 3 of the drawings. For example, one color format of this type provided eight bits of data per pixel of which two bits were allotted for each of the three colors. This allowed four possible intensities of each color to be stored. In this format, each of the two bit stored values is transferred straight to the DAC where each is translated to the appropriate analog value to provide one of the output signals for operating a RGB analog display. Such an arrangement is illustrated to the left in the top illustration of FIG. 3. This format has been rapidly bypassed by the advance of technology and has essentially died out.

In order to obtain more intensities of each of the three colors and thus more total colors, it was discovered that the entire eight bits of pixel data could be used to represent a single pixel value. This allowed 256 individual binary numbers to be stored as pixel values in the frame buffer. By providing a lookup table (called "indexing") for each of the red, green, and blue shades and using the eight bit value in the frame buffer to access a lookup value stored in each of the three lookup tables, 256 different intensities of each of the color values for red, green, and blue could be derived. Thus, the same eight bits stored in a frame buffer was able to provide a total of sixteen million different colors, only 256 of which could be selected at any one time. The top illustration in FIG. 2 shows to the right the manner in which an eight bit pixel value may be transferred to each of three individual lookup tables before translation into analog values by a DAC. It should be noted that in this indexed format, the eight bits in the frame buffer are simply a number which must be changed to a color value before being presented to the DAC. It should also be noted that in the single lookup (indexed) arrangement, the same value is sent to each of the three lookup tables. The values in the lookup tables may be selected by a setup program to provide the correct color value outputs at initial setup when the color format is chosen. This eight bit format became widely accepted and is referred to as eight bit indexed format. A very large number of early color applications provide output in this format.

The eight bit values stored in the frame buffer may also be sent straight to the DAC (as shown to the right of the upper illustration of FIG. 3) and translated to a single analog value which is applied to all three inputs of a color monitor to provide gray scale output. Since a gray scale mode uses incremental changes in gray shades to represent an image, the 256 values available when applied to all three inputs of a color monitor produce 256 shades of gray ranging from white to black. In contrast to the values stored in the eight bits in eight bit indexed mode, the eight bits stored in this mode which bypasses the lookup tables each represent color values rather than numbers which must be translated to color values.

Other more sophisticated output circuitry was also devised which allowed the storage of pixel data in various fifteen bit formats stored in a fifteen bit space in which five bits are used to represent each of the three color values. Such a formats are shown in the illustration next to the top in FIG. 3. When the three groups of five bits each are sent straight to the DAC in fifteen bit true color mode, the five bits provide only thirty-two possible intensities of each of the red/green/blue colors and a total of just over thirty-two thousand possible colors. The same fifteen bit pixel groups can also be enhanced to fifteen bit direct color (as shown in the illustration next to the top in FIG. 3) by sending each group of five bits to an individual one of the three lookup tables from which additional eight bit values representing intensities can be derived. This allows a total of sixteen million colors to be presented, thirty-two thousand of which may be selected at once.

Figure 3:
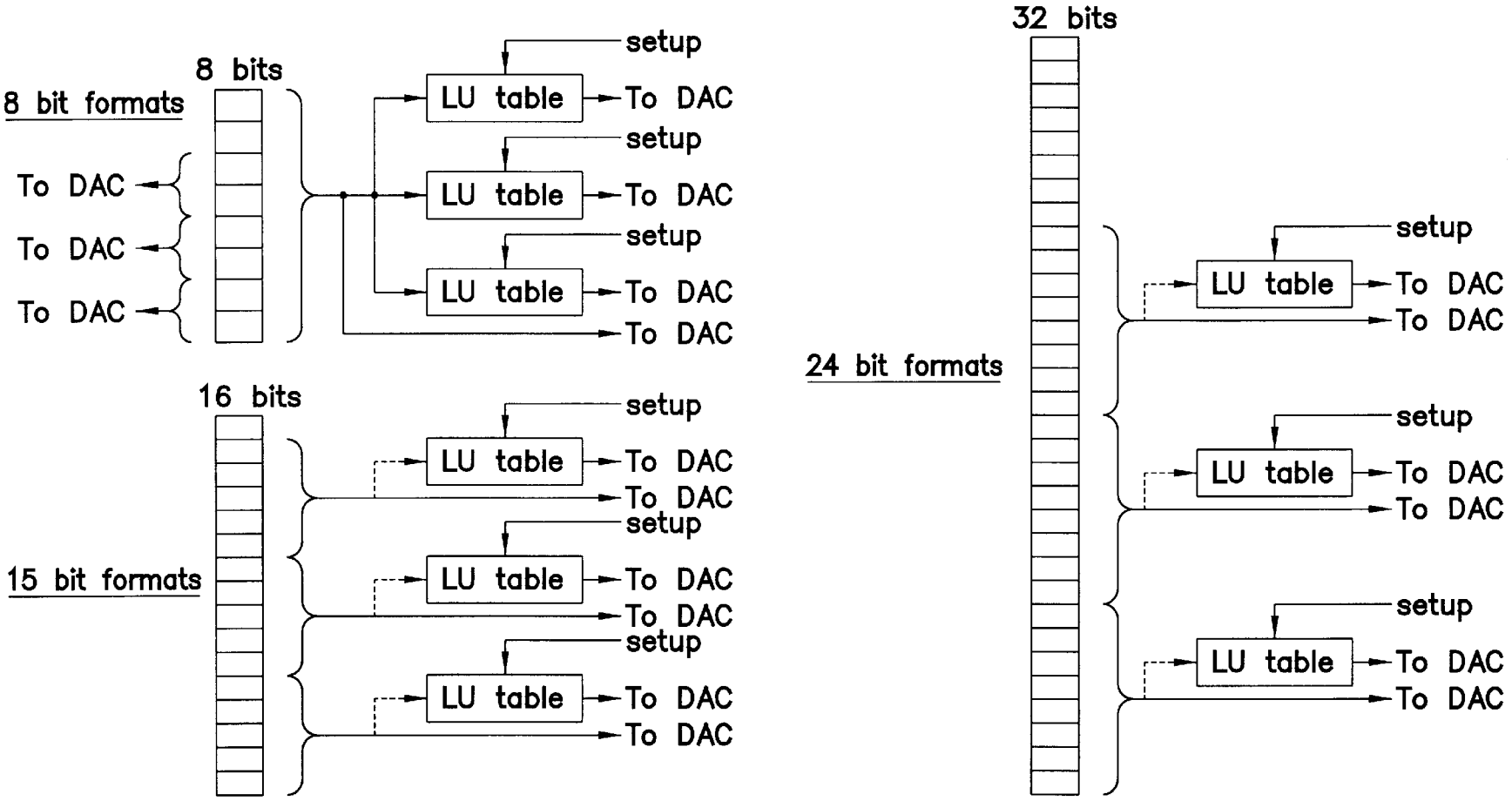
FIG. 3 is a diagram illustrating in more detail the arrangements of a number of color pixels formats and circuitry for implementing these formats using graphics output display circuitry illustrated in FIGS. 2.

These fifteen bit formats are actually methods of reducing the frame buffer size while producing color in which each of the red, green, and blue shades is allotted a sufficient number of bits so that a large number of colors are available. Fifteen bit direct mode, for example produces all of the colors available from a twenty-four bit format although from a smaller immediate selection. The more expensive method of producing this large number of colors is illustrated at the bottom of FIG. 3. The method requires a frame buffer capable of storing thirty-two bit pixels in which eight bits are provided for each of red, green, and blue shades and eight bits are left for other uses. When actual color values are stored in the frame buffer and sent straight to the DAC, this format is referred to as twenty-four bit true color. Pixel data stored in a twenty-four bit color format is usually transferred straight to the digital-to-analog conversion circuitry because all of sixteen million colors may be directly represented using the twenty-four bits available. This format may, however, utilize color lookup tables (then called twenty-four bit direct color) as do other formats although these tables are typically used only for gamma correction or color calibration to match a particular color display.

Application programs have been used which operate in each of these different color display formats. Many computer users have learned and appreciate the abilities of older application programs, especially eight bit indexed programs, for certain purposes. These same users often use more modern programs as well. In many cases, operators use multiprocessing operating systems which allow a number of different application programs to be run by a central processing unit on a time sharing basis and their outputs to be displayed simultaneously in different windows on an output display.

In order to provide a correct translation by the graphics output display circuitry of the pixel data stored in a frame buffer, it is necessary that the format being used for display be known to the graphics output display circuitry 17. Historically, this required that the output display board have connections physically set when the board was plugged into the bus connections. More recently, this initialization has occurred at setup of the system when values are chosen for the different operating conditions. Essentially, a value indicating a color format is selected by the operator and stored by the operating system. Whenever power is furnished to the computer system, this value is then placed in a register to control the format provided by the graphics output display circuitry.

This method of choosing a color display format works well so long as a single application program is being run. It also functions properly when a plurality of programs are being run simultaneously and all of the programs use the same color format which by passes the lookup tables. For example, if all programs display data in twenty-four bit true color format which does not require the use of lookup tables, one format setting is sufficient to assure that the color will be correct for all programs. However, if any lookup is required, all programs using the same format may not be displayed correctly because the lookup values to provide correct color rendition may vary from application to application. Few programs are presently being written in eight bit indexed format; most are being written in one of the formats which provides a greater selection of colors to the output display such as fifteen bit true color. A smaller number of programs are being written in twenty-four bit direct color and fewer still in fifteen bit direct color. Consequently, whenever an operator desires to run an eight bit indexed program while simultaneously running a program providing a fifteen bit color mode or a twenty-four bit color mode, the value preset to provide the color translation will be correct for only one of the programs. Thus, the color values of the other programs will be incorrect and may make the program impossible to use.

To overcome this problem and allow application programs using a number of different color formats to be correctly presented on the output display simultaneously without slowing the operation of the computer system, a new method of controlling the output format was devised. In order to control the color format, two individual bits are stored with each pixel value of an application program stored in the frame buffer. These two bits allow the selection of four different possible formats which may be displayed. The two bits have been used in combination to indicate whether the lookup tables are to be used in the digital translation and whether either a single group of color values or three groups of color values are to be decoded in generating the pixels. Since these color mode control bits are stored with the pixels, the refreshing circuitry which reads data from the frame buffer is able to interpret the format as the pixels are read from the frame buffer and direct them to the correct circuitry for translation.

Since the depth of a frame buffer to be used is typically selected at setup, the use of these two bits stored with each pixel allows color formats to be selected which complement each other and do not require the use of the same assets of the graphics display circuitry. This allows programs in different color formats to be correctly presented on the output display simultaneously.

It will be seen that by judicious selection of the modes, at least two separate modes may be operated simultaneously. This selection is made by providing a graphics driver process which recognizes the color mode of an application program and furnishes the two bit indication with each pixel value which it causes to be stored in the frame buffer. For example, with the depth of the frame buffer set to thirty-two bits, eight bit indexed pixels may be stored in one window portion of the frame buffer. These pixels will be stored by a graphics driver process in the lowest eight bits of the thirty-two bit pixel space and the two bits indicating the color mode will be stored in the two highest order bits. The color mode bits together indicate that the lookup tables are to be used and that the eight bits of data in the lowest eight bits of the pixel space is to transferred as a single group to each of the three lookup tables. These bits will thus indicate to the refreshing circuitry which reads the frame buffer that an eight bit indexed mode is to be used in pixel translation.

Another application program which utilizes twenty-four bit true color format may be stored in the same frame buffer so that it may be displayed in another window of the same display. This program provides values which cause the graphics driver program to write three individual eight bit red, green, and blue values to the three lower bytes of the thirty-two bit pixel space and writes different color mode bits to the two highest order bits. These two color mode bits will indicate that the lookup tables are to be bypassed (so that no lookup table interference will occur with the eight bit indexed pixels) and that, at this frame buffer depth, the three individual eight bit groups which represent the shades of color are each to be sent straight to the digital-to-analog conversion circuitry.

As will be understood, the frame buffer refreshing operation which reads the data and transfers it to the appropriate circuitry for translation is able to correctly represent both the eight bit indexed color and the twenty-four bit true color on the display simultaneously. The lookup tables are filled at setup to the appropriate values for presenting color in eight bit indexed mode. However, these tables are used only for the eight bit indexed mode since the three eight bit groups used in the twenty-four bit true color mode are written straight to the DAC bypassing the lookup tables.

Similarly, the output of applications using both eight bit indexed and fifteen bit true color may be stored in the same frame buffer and their colors presented correctly and simultaneously. However, typical fifteen bit color modes require five bits for each of the shades of color, a total of fifteen bits. If two other bits representing the color format must be stored with each pixel in addition to the fifteen bits representing shades in a fifteen bit mode, then more than sixteen bits (two bytes) of storage are required. Thus, additional memory must be provided in a frame buffer which is only sixteen bits deep. Fifteen bit color format pixels can, of course, be stored in a thirty-two bit deep frame buffer but only one such pixel at a time in each thirty-two bit space. This wastes an inordinate amount of frame buffer memory.

Thus, it may be seen that in order to store the most used fifteen bit color formats, at least one extra bit per pixel must be provided in the frame buffer. For a typical frame buffer storing approximately one million pixels, this requires one million extra memory devices. This cost is so great that some graphical output circuitry has been designed to provide a three part color format which allots only four bits to each of the three red/green/blue shades so that the data and the two control bits may still be stored in less than sixteen total bits.

The present invention eliminates the need for additional memory devices in the frame buffer while still allowing a number of different color formats to be correctly displayed simultaneously on an output display. The invention utilizes a different arrangement for selecting the color format utilized by an application program. Instead of storing two bits with each pixel in the frame buffer, only a single bit is stored with each pixel in the frame buffer. The bit stored with the pixel data in the frame buffer determines whether the color lookup tables are to be utilized or bypassed. This bit is referred to as a lookup/bypass bit A separate bit (called a decode bit) stored apart from the frame buffer is utilized to determine for all of the pixels in the frame buffer which use the lookup tables whether one or three groups of bits are to be transferred to the lookup tables (whether a single or triple decode format is to be used). By combining the lookup/bypass bit stored with the pixel with the separate decode bit in reading the frame buffer during the refreshing process, the refreshing circuitry determines the format for each application program. Thus, the refreshing program is able to direct the pixel data to the correct circuitry.

It should be noticed that this method of controlling the color mode requires that one of the four most used color modes be discarded since it is only for color modes that use the lookup tables that the decode bit stored apart from the pixel values controls whether a single or three groups of pixel values are sent to the lookup tables and thereafter to the DAC. Since gray scale mode is the least used, seems to be dying out, and may be otherwise emulated using this invention, that mode has been discarded and the bypass modes all utilize three groups of pixel values.

If desired, gray scale modes may still be represented by using the eight bit indexed mode. Instead of providing the lookup tables to hold colors values, the three lookup tables are filled with values identical to the 256 values stored in the frame buffer. When the same values are presented to the DAC for each of the color channels, gray scale values will be produced. For example, if the value eight is stored as eight bits in the frame buffer, and this value is sent to each of the three lookup tables which in turn each produces the same value eight as an output, these three values will cause the DAC to produce a shade of gray on the output display.

Another way of emulating the gray scale mode utilizes the true color mode which does not require the use of the lookup tables. A user replicates the gray scale value for each of the red, green, and blue channels so that the values are replicated as they are stored in the frame buffer. When sent directly to the DAC, a gray scale emulation is produced.

In one embodiment of the invention, the decode bit stored apart from the frame buffer is stored in a register which is a part of the graphics output display circuitry. Stored in the same register are bits which select the depth to be used in determining the depth of the frame buffer to be used. The decode bit may also be stored in some other convenient place such as in system software where it may be conveniently furnished to the graphics driver software which writes to the frame buffer and to system refreshing software. The significance of the storage of the decode bit apart from the pixel values in the frame buffer is that a single decode bit stored somewhere in the system replaces what is typically a million individual memory elements.

The present invention allows different color formats to be correctly presented on the output display simultaneously without requiring additional storage devices for the fifteen bit color modes. In order to control the color format, at least two individual indications are utilized. The first indication is the single lookup/bypass bit stored with each pixel value which is stored in the frame buffer. This bit is placed by the graphics driver (or rendering engine circuitry) with the pixel value in the space provided in the frame when the pixel value is stored. The graphics driver recognizes the color format in which the application program is operating and the depth of the frame buffer in use and places the pixel value and the color mode bits in the correct positions. The bit stored with the pixel value indicates whether the lookup tables are to be used in the digital translation. Consequently, this bit indicates whether color pixel values of any size are to be sent straight to the digital-to-analog converter circuitry or are to be routed via the lookup tables. By the use of this lookup/ bypass bit, it will be seen that simply reading this bit value stored with the pixel data provides at least two different possible translations for each type of value stored in the frame buffer to represent a pixel, either straight to the DAC or to the lookup tables.

The second indication, the decode bit, is in one embodiment transferred to a register on the graphics output display circuitry on setup and controls the manner in which the pixel data is decoded by the lookup tables for each individual application being run which uses the lookup tables. This indication (which might actually be one or more bits depending on the implementation), controls whether single of triple decode is to be used in translating the pixel values in the frame buffer. Thus, this bit indicates the group format in which the bits are stored in and retrieved from the frame buffer when the lookup tables are used. Since the values stored in the frame buffer are only numbers indicating a lookup table position to be accessed when a lookup table is used, the decode bit is also an indication of the color table values which are actually stored in the lookup tables when a program using those tables is run. When the decode bit is combined with the lookup/bypass bit stored with the pixel in a frame buffer of a particular depth, the color format in which the bits are stored and read from the frame buffer is determined.

As mentioned earlier, an additional indication controlling frame buffer setup may be stored in a register on the graphics output display circuitry or in system software and used to indicate the depth of the frame buffer being used. With a large frame buffer capable of storing pixel data in thirty-two bit spaces, this bit allows the selection of an eight bit depth, a sixteen bit depth, or a thirty-two bit depth for storing pixels. All of these frame buffer depths may be utilized with formats provided by the present invention. A frame buffer might also function constantly at a single depth and not provide the facility to change the storage depth yet still be used in implementing the present invention.

Figure 5:
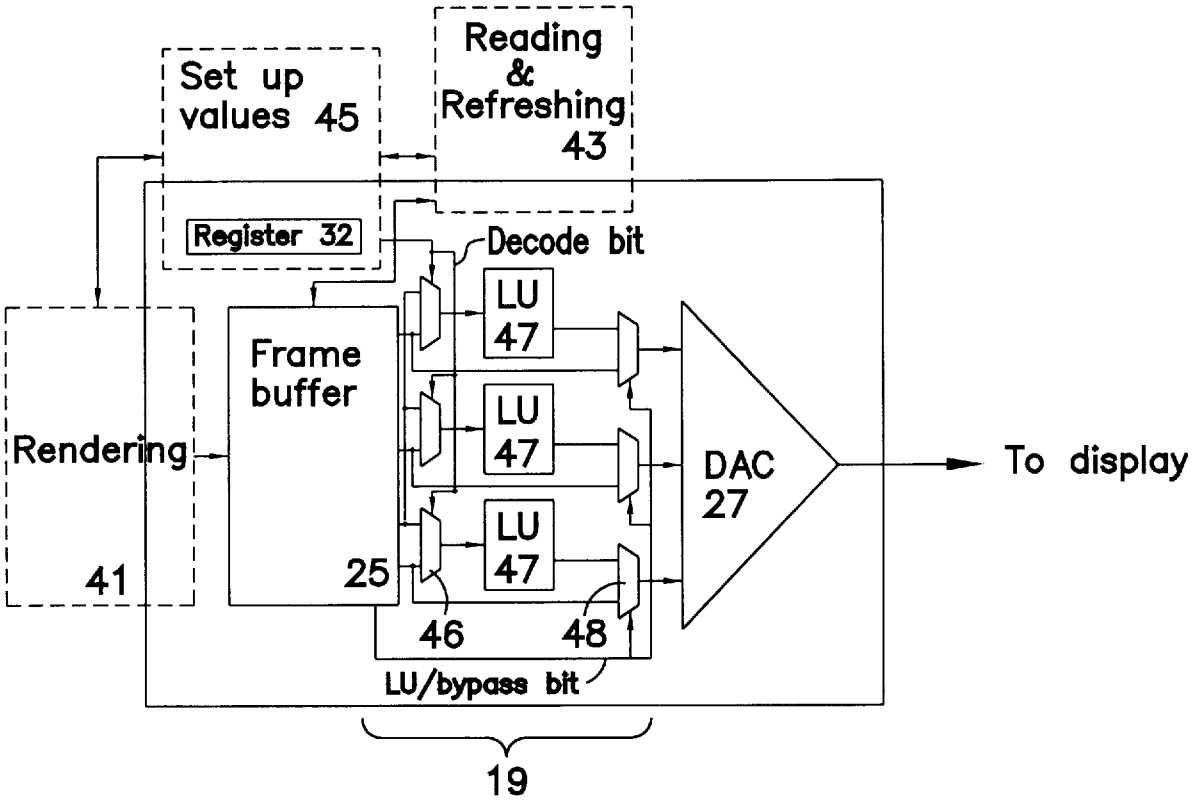
FIG. 5 is a block diagram illustrating graphics output display circuitry designed in accordance with the present invention.

FIG. 4 shows two examples of the present invention. The examples shown in FIG. 4 represent bits stored in a frame buffer 25. The circuitry of FIG. 5 should be referred to in order to assist in understanding these examples. As may be seen, FIG. 5 includes a frame buffer 25 arranged to store data in the various pixel patterns described. Means 41 is provided for transferring data to the frame buffer in accordance with the depth of the frame buffer selected and the color mode of the application program. The means 41 may be a software graphics driver process or it may be a rendering engine implemented in hardware in a manner well known to the prior art; for example, computers designed by Silicon Graphics Inc. include such a high speed graphics rendering engine. Means 43 is illustrated for refreshing and reading data from the frame buffer in the appropriate patterns depending on the depth of the frame buffer and the color mode of the application. Means 43 may be a software program run by the central processing unit or a hardware refreshing and reading engine known to the prior art. A storage means 45 for setup or initial values is also illustrated. This storage means 45 may comprise system software, a register on the graphics output display circuitry, a register associated with the central processing unit, or some other means of retaining setup values. Typically, a register 32 of a hardware storage means 45 will store bits indicating the depth of the frame buffer 41 and a decode bit (or bits) which together with a lookup/bypass bit in a pixel stored in the frame buffer indicates the color mode of operation selected. Also shown in FIG. 5 are lookup tables 47, digital-to-analog conversion circuitry 27, and circuitry connecting to those circuits from the frame buffer.

This latter circuitry includes a first set of multiplexors 46 which are controlled by the value of the decode bit held in the storage means 45 for selecting whether bits are transferred from the frame buffer to the lookup tables in a single group or in three individual groups. The connecting circuitry also includes a second set of three multiplexors 48 controlled by the lookup/bypass bit stored with the pixel values in the frame buffer for selecting whether pixel values transferred straight from the frame buffer 25 or pixel values provided by the lookup tables are transferred to the DAC 27.

In the upper diagram of FIG. 4 is illustrated an example of an embodiment in which pixels are stored in a sixteen bit deep frame buffer (e.g., as selected by the depth bit referred to above which may be stored in register 32). As is shown, if a decode bit indicating a triple decode operation is set to a zero at system setup and if a lookup/bypass bit (bit 15) stored with the pixel data is also set to a zero to indicate a lookup, then pixel data is retrieved from the frame buffer in three five bit increments of red, green, and blue and each is referred to an individual lookup table for translation to a color value. This is as indicated, a fifteen bit direct color mode. On the other hand, if the decode bit is set to a one to indicate a single group of pixel values are decoded and if the lookup/bypass bit stored with the pixel value is set to a zero to indicate a lookup, the data is stored in eight bit indexed format in the lowest eight bits of the pixel. When the data is read as the frame buffer is refreshed, the same eight bit value is referred to each of the lookup tables 47 to provide three eight bit red/green/blue shades for transfer to the DAC. This is as indicated, the eight bit indexed format. Finally, if the decode bit in the register 32 is in either state and the lookup/bypass bit in the pixel is set to a one to indicate that the lookup tables are to be bypassed, then with a frame buffer having a sixteen bit depth, the pixel data is stored in five bit increments of red, green, and blue; and each five bits of the data read is referred straight to the DAC bypassing the lookup tables. This is fifteen bit true color mode. This latter mode is the only mode in the preferred embodiment which furnishes color value bits straight to the DAC from the frame buffer. By using additional decode bits in the storage means 45, additional bypass modes could be provided.

It will be seen that by judicious selection of the modes, at least two separate modes may be operated simultaneously. This selection is made by providing a graphics driver process which determines the color mode of the application program and furnishes a lookup/bypass bit indication with each pixel value stored in the frame buffer. For example, with the depth of the frame buffer set to sixteen bits and the decode bit set to one, eight bit indexed pixels may be stored in a window portion of the frame buffer. These pixels will be stored by a graphics driver process in the lowest eight bits and a lookup/bypass bit indicating that the lookup tables are to be used may be set to a zero as indicated in the example. The same set of lookup and decode bits stored with the pixel value and in the register 32 indicates to the refreshing circuitry that the pixel data is to be interpreted as an eight bit indexed pixel value when read from the frame buffer. Moreover, this set of bits is directly related to the values which are stored in the lookup tables in order that the pixel values in the frame buffer produce the appropriate colors when sent to the display.

Simultaneously, with the frame buffer depth set at sixteen and the decode bit set to either a one or a zero, fifteen bit true color mode pixels may also be stored in other portions of the frame buffer for presentations in other windows on the display. Since these pixel values are of a format type which does not require the use of the lookup tables, these pixel values will be stored by such a graphics driver process in five bit groups with a lookup/ bypass bit (bit 15) set to a one indicating that the lookup tables are to be bypassed. This same lookup/bypass bit stored with the pixel values indicates to the refreshing circuitry in this embodiment that the pixel data is to be interpreted as fifteen bit true color mode when read from the frame buffer.

It will be clear from the diagram of FIG. 4 that application programs in both the fifteen bit direct color (lookup) mode and fifteen bit true color mode may also be operated simultaneously. Thus, at least one eight bit indexed or direct color application program may be operated in a window simultaneously with the display of a plurality of fifteen bit application programs which do not utilize the color lookup tables. The colors provided for each of the programs will be the appropriate colors for that program. Even more importantly, this may be accomplished without the need to add substantial additional memory to the frame buffer as would be required by arrangements of the prior art.

In a similar manner, in a frame buffer which is operating to store pixel data in thirty-two bit increments (typically controlled by a registered depth bit) as is illustrated at the bottom of FIG. 4, a lookup/bypass bit may be stored as the highest order (31st) bit when the data is written to the frame buffer by the graphics driver. In the embodiment illustrated, if this bit is a zero value, then the lookup tables are used. If the lookup/bypass bit is a one, then the lookup tables are bypassed. If then, the color decode mode bit is set to a one in the register 32, the data is stored and read for transfer to the DAC as an eight bit pixel in the eight lowest order bits. When the data is read for transfer to the DAC, the same eight bit value is transferred to each of the lookup tables to provide eight bit indexed output to the DAC for display. On the other hand, twenty-four bit direct color may also be stored in the thirty-two bits in eight bit increments. If a zero is stored as the lookup/bypass bit, then the eight bits in each of the red, green, and blue portions of the pixel data are transferred separately to the three lookup tables to provide what is twenty-four bit direct color typically used for gamma correction and color calibration. It is more useful to store twenty-four bit pixels in a format in which the lookup tables are bypassed (true color format). This causes the pixel data to be read from the frame buffer in twenty-four bit bypass mode. As with the example given above in which pixels are stored in a frame buffer at a sixteen bit depth, two different color formats may be displayed at once. In the embodiment illustrated in which a thirty-two bit frame buffer depth is used, by selecting a decode mode bit of one, eight bit indexed pixels may be stored with a high order lookup/ bypass bit (bit 31) of zero indicating the eight bit indexed mode. At the same time, twenty-four bit bypass mode pixels may be stored in the same frame buffer. Both sets of pixels will be read from the frame buffer to produce the correct color format for the pixels of that application program. Alternatively, twenty-four bit true color and twenty-four bit direct color formats may be displayed at once. Thus, at least two application programs having different colors formats may be run simultaneously and produce correct output color displays.

It will be recognized that the bit used to indicate whether or not the lookup tables are used determines whether pixel bit values are transferred to the digital-to-analog converter circuitry or to the lookup tables for the eight bit pixel. Since the pixels, whether eight, fifteen, or twenty-four bits, are each stored in the same positions in the frame buffer, the single bit stored with each pixel value in the frame buffer actually allows different possible formats to be extracted as the individual bits are read from the frame buffer. Consequently, both fifteen true color and eight bit indexed values, the most used formats, may displayed on the same output display simultaneously and correct colors will be presented in each format. Similarly, fifteen bit true color and direct color formats may both be presented on the same display at the same time with the appropriate selection of lookup and decode bits. This allows the color mode to be indicated in the fifteen bit modes without requiring additional frame buffer storage as with the prior art systems.

When operating in accordance with the present invention, a decode mode indication is transferred to the graphics output display circuitry on setup for the application programs which are to be displayed. This indication, which is usually a single bit, is stored in a register in one embodiment and allows the rendering engine or a graphics driver to test the individual application programs to determine whether the color decode mode is single or triple. When the rendering engine or graphics driver writes correct pixel values to the frame buffer, it includes the correct lookup/bypass bit for the pixel data stored. The decode indication and the lookup/ bypass bit allows the refresh operation which reads the pixels from the frame buffer to correctly interpret all of the data read with each pixel and transfer the pixel data to the appropriate circuitry for translation. Thus, for instance, the decode indication and the knowledge of the application requiring lookup might indicate that the data is to be stored as eight bits only in the lower valued eight bits when thirty-two bits of space is provided for each pixel, and that the lookup table is to be used. The rendering engine would place the eight bits of data in the first byte of the thirty-two bits of space and set the lookup/bypass bit in the fourth byte to the correct value to indicate that the lookup table is to be used. The decode indication would cause the refresh operation to read out eight bits from the thirty-two bits in which each pixel is stored, check the format to see that only the first eight bits were to be used, check the bit in the high byte with the data to determine that the eight bits were to be sent to the lookup tables, and accomplish all of these operations. Similarly, the knowledge of the application being a bypass mode operation from the lookup/bypass bit and the knowledge of the format from the application might indicate with a sixteen bit frame buffer that the data is to be stored as fifteen bits in a five/five/five arrangement in the lower valued fifteen bits of space provided for each pixel, and that no lookup table is to be used. The rendering engine would place the fifteen bits of data in the lower order bits of the space and set the lookup/bypass bit in the fifteenth bit to the correct value to indicate that no lookup table is to be used. The refresh operation would read out fifteen bits from the space in which each pixel is stored in five bit increments, check the bit in the high byte with the data to determine that the each five bit sequence is to be sent to the DAC bypassing the lookup tables, and accomplish all of these operations.

Alternatively, the application format might indicate that the rendering engine is to store three individual eight bit color values in the three lower valued bytes of thirty-two bits of space for each pixel and that the lookup table is not to be used. This would cause the rendering engine to place the three individual bytes which make up the twenty-four bits of data in the first three bytes and set the lookup/bypass bit in the fourth byte to the correct value to indicate that the lookup table is not to be used. The refresh operation would read out twenty-four bits from the thirty-two bit space for each pixel and send each of the eight bits straight to the digital-to-analog converter bypassing the lookup tables.

A special advantage of the arrangement of the present invention is that it allows a very substantial power saving to be accomplished. By determining that there are no applications being run which utilize the lookup tables, the power to those tables may be turned off. Since these tables each include 256 entries each of which provides eight bits of color data and three tables are involved, a total of 6144 memory devices (bits) may be disabled. This is a substantial portion of the circuitry of the graphics output display control circuit. When combined with the circuitry necessary to provide addressing and other operational functions for the tables, a substantial power saving may be achieved.

The detection of whether any application is using the lookup tables may be accomplished whenever any new application is selected to be run. Alternatively, the lookup/decode bits stored in the frame buffer may be utilized. In any case, when the determination has been made, a bit may be stored (e.g., in setup storage 45) to indicate that power and clocks to the lookup portion of the circuitry are to be disabled. The disabling may be accomplished in any of a number of well known techniques known to those skilled in the art.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A computer system comprising:

a central processing unit;

a system bus;

main memory;

a graphics output circuit comprising a frame buffer including a memory array for storing pixel data, digital-to-analog converter circuitry for translating digital pixel data to analog data to operate a color monitor, and a plurality of color lookup tables for storing color values representing each of red, green, and blue color;

bit positions in the memory array of the frame buffer for storing with each pixel value a first single bit indication for ascertaining a color mode to be used for display;

storage circuitry apart from the memory array for storing a second indication for ascertaining a color mode to be used for display; and color mode selection circuitry responsive to the first and second indications to determine the color mode to be used for display.

2. A computer system as claimed in claim 1 in which the first single bit indication indicates whether the color lookup tables are to be utilized in translating the pixel value.

3. A computer system as claimed in claim 1 in which the second indication is at least one bit which indicates a decode mode to be used for sending pixel values from the frame buffer to the color lookup tables.

4. A computer system as claimed in claim 3 in which the storage circuitry apart from the memory array for storing a second indication for ascertaining a color mode to be used for display comprises a register on the graphics output circuitry for storing setup values.

5. A computer system as claimed in claim 4 in which frame buffer size is selectable, and in which the register on the graphics output circuitry also stores an indication of the depth of the frame buffer to be used.

6. A computer system as claimed in claim 1 further comprising storage for an indication that no application program being run requires the color lookup tables, and a circuit to disconnect power from the color lookup tables in response to an indication that no application program being run requires the color lookup tables.

7. A computer system as claimed in claim 1 in which the color mode selection circuitry responsive to the first and second indications to determine the color mode to be used for display determines whether to transfer color values from the frame buffer straight to the digital-to-analog converter circuitry or to route the color values from the frame buffer to the lookup tables and transfer values from the lookup tables to the digital-to-analog converter circuitry depending on the second indication.

8. A computer system as claimed in claim 1 in which the second indication comprises a single bit of binary data.

9. A graphics output circuit comprising a frame buffer including a plurality of memory devices for storing pixel data in a plurality of formats with a single bit with each pixel value to indicate the display format, digital-to-analog converter circuitry for translating digital pixel data to analog data to operate a color monitor, and a plurality of color lookup tables for storing color values representing each of red, green, and blue color;

storage apart from the frame buffer of an indication of a display format to be used for display; and switching circuitry for utilizing the single bit and the indication to determine the display format to be used for display.

10. A graphics output circuit as claimed in claim 9 in which the single bit with each pixel value indicates whether a lookup table is to be utilized in translating a pixel value.

11. A graphics output circuit as claimed in claim 9 in which the storage apart from the frame buffer of an indication comprises a register on the graphics output circuitry for storing an indication of a display format of operation.

12. A graphics output circuit as claimed in claim 11 in which size of the frame buffer which may be utilized is selectable, and in which the register on the graphics output circuitry also stores an indication of the depth of the frame buffer to be used.

13. A graphics output circuit as claimed in claim 9 in which the indication is at least one bit which indicates a decode mode to be used for sending pixel values from the frame buffer to the color lookup tables.

14. A graphics output circuit as claimed in claim 9 further comprising circuitry storing an indication that no application program being run requires the color lookup tables, and means for disabling power to the color lookup tables in response to an indication that no application program being run requires the color lookup tables.

15. A graphics output circuit as claimed in claim 9 in which the switching circuitry for utilizing the single bit and the indication to determine the display format to be used for display determines whether to transfer pixel values from the frame buffer straight to the digital-to-analog converter circuitry or to route the pixel values from the frame buffer to the lookup tables and transfer values from the lookup tables to the digital-to-analog converter circuitry.

16. A graphics output circuit as claimed in claim 9 in which the indication comprises a single bit of binary data.

17. A method of displaying a plurality of application programs providing output in different color formats on the output display of a digital system simultaneously in correct color renditions comprising the steps of:

storing in the frame buffer with each pixel value a first single bit indication for ascertaining a color mode to be used for display, storing a second indication for ascertaining a color mode to be used for display apart from a frame buffer in which pixel data is stored, and utilizing the first and second indications to determine the color mode to be used for display as each pixel is read from the frame buffer for display.

18. A method of displaying a plurality of application programs as claimed in claim 17 in which the step of utilizing the first and second indications to determine the color mode to be used for display includes the steps of determining from the first single bit indication whether the pixel values are to be transferred to lookup tables or straight to digital-to-analog converter circuitry, and determining from the second indication the decode grouping of pixel values stored in the frame buffer which are to be transferred to the lookup tables.

19. A method of displaying a plurality of application programs as claimed in claim 17 comprises the additional steps of:

for any application program displaying output in gray scale format, loading each of the color lookup tables with the same values which values are the same as pixel values stored in the frame buffer for the application program, and selecting the single bit to indicate use of the color lookup tables.

20. A method of displaying a plurality of application programs as claimed in claim 17 comprises the additional steps of:

for any application program displaying output in gray scale format, storing identical values in the frame buffer for each of red, green, and blue components of a pixel value; and selecting the single bit to indicate the color lookup tables are not to be used.

21. A method of displaying a plurality of application programs as claimed in claim 17 comprises the additional steps of: ascertaining whether any application program running utilizes the color lookup tables, and removing power from the color lookup tables if no application utilizes the color lookup tables.

* * * * *